US007271777B2

(12) United States Patent
Yuanzhu

(10) Patent No.: US 7,271,777 B2
(45) Date of Patent: Sep. 18, 2007

(54) ANTENNA DEVICE WITH IMPROVED ISOLATION CHARACTERISTIC

(75) Inventor: Dou Yuanzhu, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 134 days.

(21) Appl. No.: 11/303,295

(22) Filed: Dec. 15, 2005

(65) Prior Publication Data

US 2006/0132373 A1 Jun. 22, 2006

(30) Foreign Application Priority Data

Dec. 20, 2004 (JP) ..... 2004-367764

(51) Int. Cl.
*H01Q 13/10* (2006.01)
*H01Q 1/36* (2006.01)

(52) U.S. Cl. ..... 343/767; 343/700 MS; 343/770; 343/767; 343/725

(58) Field of Classification Search ..... 343/700 MS, 343/767, 770, 895, 725, 795, 727
See application file for complete search history.

(56) References Cited

U.S. PATENT DOCUMENTS 6,133,879 A * 10/2000 Grangeat et al. .... 343/700 MS
6,160,513 A * 12/2000 Davidson et al. .... 343/700 MS
6,762,730 B2 * 7/2004 Schadler ..... 343/770
7,193,576 B2 * 3/2007 Yazdandoost et al. ..... 343/767
2006/0038724 A1 * 2/2006 Tikhov et al. ..... 343/700 MS

FOREIGN PATENT DOCUMENTS

JP 2003-234615 8/2003

* cited by examiner

*Primary Examiner*—Douglas W. Owens
*Assistant Examiner*—Chuc Tran
(74) *Attorney, Agent, or Firm*—Brinks Hofer Gilson & Lione

(57) ABSTRACT

A pair of radiating slots open in a flat metal plate having a square shape to be line-symmetrically arranged with respect to a symmetry axis, and power feeding lines and ground lines are provided at power feeding positions of the respective radiating slots. The respective radiating slots have first slot portions and second slot portions that contact at 45 degrees and linearly extend, respectively. Both the radiating slots are arranged in a back-to-back manner that edges of the first slot portions face each other, and the second slot portions extend in a direction to be separated from each other along two sides of the flat metal plate. Further, a polarization direction of an electric wave to be generated by one radiating slot and a polarization direction of an electric wave to be generated by the other radiating slot are set to be perpendicular to each other.

7 Claims, 3 Drawing Sheets

ANTENNA DEVICE WITH IMPROVED ISOLATION CHARACTERISTIC

BACKGROUND OF THE INVENTION

1. Field of the Invention

The present invention relates to a small antenna device in which a pair of radiating slots are provided to constitute a diversity antenna.

2. Description of the Related Art

As the related art of such an antenna device, as shown in FIG. 6, a configuration is known in which a pair of radiating slots 32 and 33 open in a metal case 31 of a wireless LAN card 30 and are electromagnetically coupled to microstrip lines 34 and 35 to be fed, respectively (for example, see Japanese Unexamined Patent Application Publication No. 2003-234615 (pages 3-4 and FIG. 1)). Each of the radiating slots 32 and 33 opens in an L shape to extend along the external shape of the metal case 31. Since one end of the radiating slot 32 faces one end of the radiating slot 33, the pair of radiating slots 32 and 33 are line-symmetrically arranged. The microstrip lines 34 and 35 are formed in a circuit board 36 housed in the metal case 31 so as to be connected to a power feeding circuit (not shown). The microstrip line 34 faces a power feeding position of the radiating slot 32 and the microstrip line 35 faces a power feeding position of the radiating slot 33.

In the related art antenna device having such a schematic configuration, when the radiating slots 32 and 33 are excited by power feeding via the microstrip lines 34 and 35, a radiation electric field is generated in each of the radiating slots 32 and 33, and then an electric wave is generated. At that time, the polarization direction of the electric wave generated by the radiating slot 32 and the polarization direction of the electric wave generated by the radiating slot 33 are different from each other. Accordingly, if a diversity antenna has the pair of radiating slots 32 and 33, a wireless LAN signal wave in which a variation in the polarization direction occurs due to multipath may be received.

If the pair of radiating slots 32 and 33 are provided in parallel and excited in the metal case 31 which serves as a common conductor member, surface currents flowing the environs of the individual radiating slots 32 and 33 are intensively coupled to each other, and thus an isolation characteristic tends to deteriorate. For this reason, the pair of radiating slots are significantly spaced from each other in order to enhance the isolation characteristic. If the gap between the radiating slots 32 and 33 is widened, the entire antenna device is made large. Accordingly, a desired reduction in size can be realized at the expense of the isolation characteristic to some extent. Further, in the related art, each of the radiating slots 32 and 33 is formed in the L shape along the external shape of the metal case 31 in view of a space factor. In this case, however, at the time of excitation, the electric field generated in each of the radiating slots 32 and 33 wraps around the side surface of the metal case 31, such that the lateral radiation is increased. Accordingly, the radiation electric fields of the individual radiating slots are intensively coupled to each other, which results in deterioration of the isolation characteristic. That is, when it is going to promote the entire device to be reduced in size, the isolation characteristic deteriorates, which tends to cause a trouble in antenna performance. To the contrary, when it is going to insure a desired isolation characteristic, there is a problem in that it is impossible to promote the entire device to be reduced in size.

Moreover, in such an antenna device, if the isolation characteristic is not favorable, in a transmission mode, radiation efficiency gets worse, and also, in a reception mode, a desired beam pattern cannot be formed. Accordingly, transmission or reception performance is degraded.

SUMMARY OF THE INVENTION

The invention has been made in consideration of the drawbacks inherent in the related art, and it is object of the invention to provide an antenna device which can promote a reduction in size with a favorable isolation characteristic of a pair of radiating slots provided in parallel.

In order to achieve the above-described objects, according to an aspect of the invention, an antenna device includes a pair of radiating slots that open in a common conductor member to be line-symmetrically arranged with respect to a predetermined symmetry axis, and power feeding units that excite the radiating slots, respectively. Each of the radiating slots has a first slot portion, one edge of which is close to the symmetry axis, and a second slot portion that is connected to one end of the first slot portion to extend in a direction distant from the symmetry axis. A polarization direction of an electric wave to be generated by one radiating slot and a polarization direction of an electric wave to be generated by the other radiating slot are set to be perpendicular to each other.

In the antenna device having such a configuration, the polarization direction of the electric wave to be generated by one of the radiating slots line-symmetrically arranged and the polarization direction of the electric wave to be generated by the other radiating slot are set to be perpendicular to each other. Accordingly, even when the gap between the pair of radiating slots is narrow, an isolation characteristic can be ensured. Therefore, a reduction in size of the entire device can be promoted, without sacrificing the isolation characteristic. Further, the pair of radiating slots are arranged in a back-to-back manner that edges of the first slot portions face each other with the symmetry axis interposed therebetween, and the second slot portions extend to be connected to one end of the first slot portions in a direction to be separated from each other. Accordingly, even when the entire device is reduced in size, the electric field to be generated by at least the first slot portion of each of the radiating slots is hard to radiate to the lateral side. Accordingly, the first slot portion does not cause degradation of the isolation characteristic. Further, if the angle at which the first slot portion and the second slot portion contact is set to an acute angle (less than 90 degrees), the pair of radiating slots are provided in parallel in the narrow area of the conductor member in the back-to-back manner, as compared with a case in which the pair of L-shaped radiating slots are provided in parallel. As a result, a space factor can be enhanced, and thus the reduction in size of the entire device can be further promoted and easily realized.

In the above-described configuration, if the first slot portion extends in parallel with respect to the symmetry axis, the space factor can be further enhanced. In this case, an external shape of the conductor member may be substantially a square shape in plan view, one diagonal line of the square shape may be aligned with the symmetry axis, and an angle at which the first and second slot portions contact may be set to about 45 degrees. By doing so, in the pair of radiating slots, the first slot portions are arranged in parallel with the diagonal line interposed therebetween, and the second slot portions are arranged along two adjacent sides of the square shape. Therefore, the reduction in size of the entire device can be rapidly promoted. Moreover, in addition to such a configuration, each of the radiating slots may have a third slot portion that is connected to an end of the second slot portion opposite to the side, which is connected to the first slot portion, so as to extend along an outer edge of the square shape. In this case, a resonance of each of the radiating slots can be increased without damaging the space factor, and thus the reduction in size can be further realized.

Further, in the above-described configuration, the conductor member may be formed of a metal plate or a metal film. When the conductor member is formed of the metal plate, two metal pieces may be provided in a peripheral portion of each of the radiating slots. The metal pieces are obtained by bending extended portions of the metal plate from two places as base ends with the corresponding radiating slot interposed therebetween in its widthwise direction. One of the two metal pieces becomes a power feeding line and the other metal piece becomes a ground line. In this case, the entire antenna device including the power feeding unit can be formed with only a sheet metal, and thus manufacturing costs can be markedly reduced.

Further, the conductor member may be formed of a metal film formed in a dielectric substrate. In this case, the reduction in size can be promoted with a wavelength shortening effect by the dielectric.

DESCRIPTION OF THE PREFERRED EMBODIMENT

Figure 1:
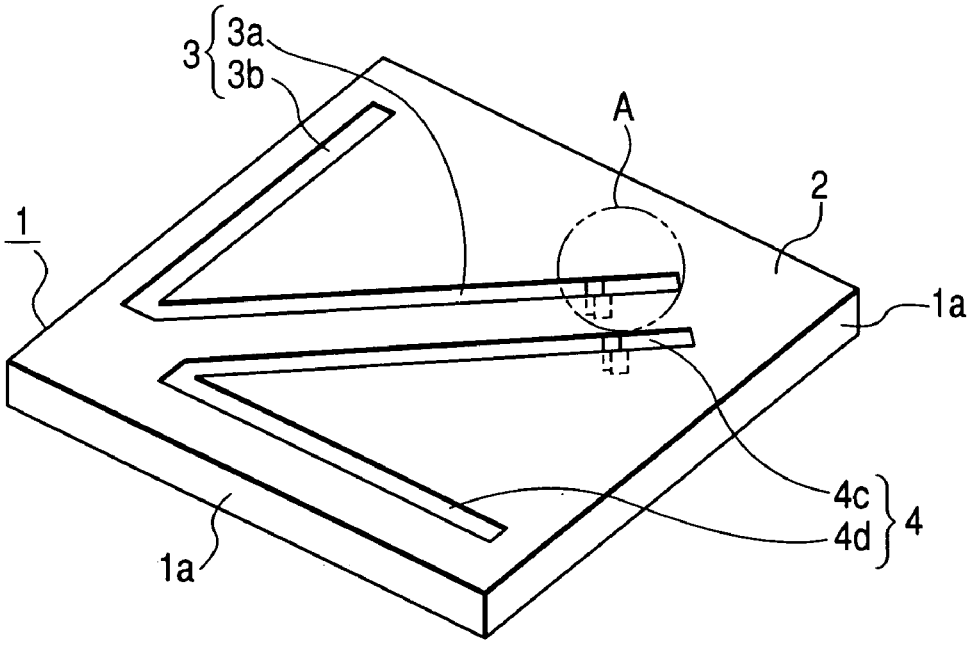
FIG. 1 is a perspective view of an antenna device according to a first embodiment of the invention.
Figure 2:
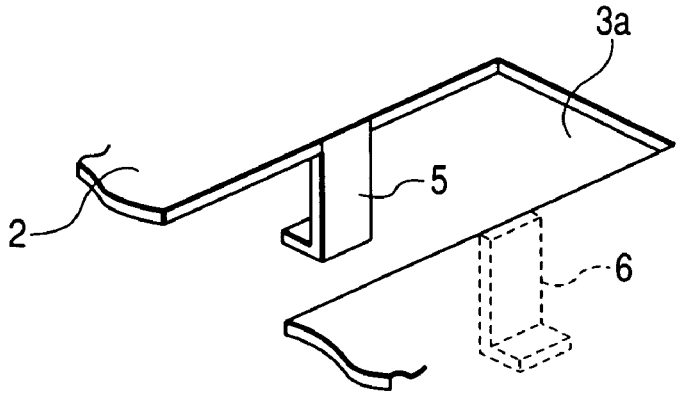
FIG. 2 is an expanded view of an A portion in FIG. 1.
Figure 3:
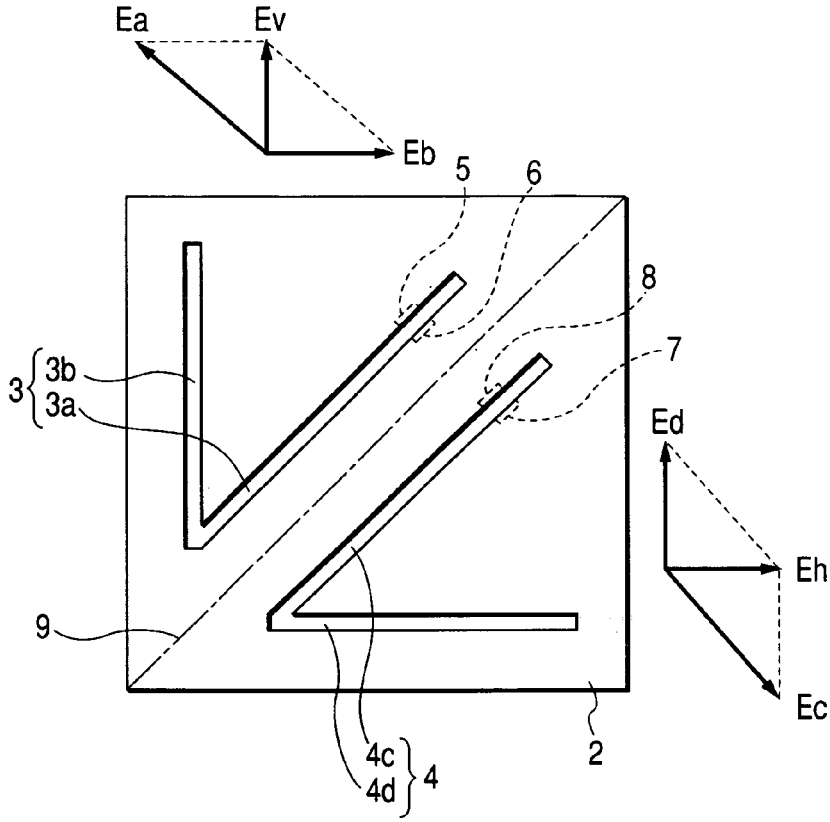
FIG. 3 is a plan view of the antenna device according to the first embodiment of the invention.
Figure 4:
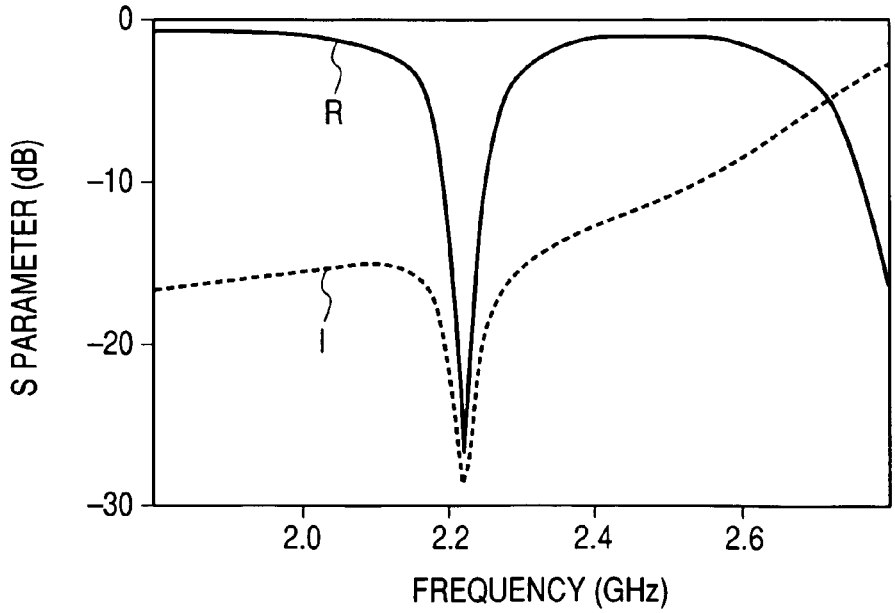
FIG. 4 is a characteristic diagram showing an S parameter of the antenna device according to the first embodiment of the invention.

Embodiments of the invention will be described with reference to the drawings. FIG. 1 is a perspective view of an antenna device according to a first embodiment of the invention. FIG. 2 is an expanded view of an A portion in FIG. 1. FIG. 3 is a plan view of the antenna device. FIG. 4 is a characteristic diagram showing an S parameter of the antenna device.

The antenna device showing in FIGS. 1 to 3 is schematically configured to have a boxlike metal case 1, a top plate of which is formed of a flat metal plate 2 having a square shape, a pair of radiating slots 3 and 4 that open in the metal plate 2, a power feeding line 5 and a ground line 6 that extend downward from power feeding positions of one radiating slot 3, and a power feeding line 7 and a ground line 8 that extend downward from power feeding positions of the other radiating slot 4.

The metal case 1 is obtained by pressing a sheet metal. The metal case 1 is molded in a box shape by bending four side plates downward from individual sides of the flat metal plate 2. The metal case 1 is disposed on a circuit board (not shown), which has high frequency circuits, such as a power feeding circuit and the like. The length of one side of the flat metal plate 2 is 60 mm.

The individual radiating slots 3 and 4 are formed by punching the flat metal plate 2 in predetermined shapes. The width of each of the radiating slots 3 and 4 is 2 mm. The pair of radiating slots 3 and 4 are line-symmetrically arranged with respect to a symmetry axis 9, which is aligned with one diagonal line of the flat metal plate 2. In the radiating slot 3, one end of a first slot portion 3*a* extending in parallel with and to be close to the symmetry axis 9 is connected to one end of a second slot portion 3*b* extending in parallel with and to be close to an outer edge (left side in FIG. 3) of the flat metal plate 2. Both slot portions 3*a* and 3*b* contact at 45 degrees. Similarly, in the radiating slot 4, one end of a first slot portion 4*c* extending in parallel with and to be close to the symmetry axis 9 is connected to one end of a second slot portion 4*d* extending in parallel with and to be close to an outer edge (lower side in FIG. 3) of the flat metal plate 2. Both slot portions 4*c* and 4*d* contact at 45 degrees. That is, the radiating slot 3 and the radiating slot 4 having the positional relationship of line symmetry are arranged in a back-to-back manner such that edges of the first slot portions 3*a* and 4*c* face each other with the symmetry axis 9 interposed therebetween, and the second slot portions 3*b* and 4*d* extend in a direction to be separated from each other. Further, the second slot portions 3*b* and 4*d* are provided along two sides of the flat metal plate 2. Therefore, the radiating slots 3 and 4 can be efficiently arranged in a limited area, and a reduction in size of an entire antenna device can be rapidly promoted.

Further, each of the radiating slots 3 and 4 is set to generate electric fields indicated by vectors shown in FIG. 3 at the time of excitation by suitably selecting the ratio between the lengths of the first and second slot portions or power feeding positions. That is, in FIG. 3, an electric field to be generated by the first slot portion 3*a* of the radiating slot 3 is indicated by Ea, and an electric field to be generated by the second slot portion 3*b* is indicated by Eb. Further, an electric field to be generated by the first slot portion 4*c* of the radiating slot 4 is indicated by Ec, and an electric field to be generated by the second slot portion 4*d* is indicated by Ed. The electric fields Ea and Ec are parallel and have the same size, and the electric fields Eb and Ed are perpendicular to each other and have the same size. Further, since the electric fields Ea and Eb contact at 135 degrees (the same is applied to the electric fields Ec and Ed), by designing such that the ratio of the sizes of the electric fields Ea and Eb is $\sqrt{2}$:1, the direction of a compound vector Ev of radiation electric fields of the radiating slot 3 is set to be perpendicular to the direction of a compound vector Eh of radiation electric fields of the radiating slot 4.

As shown in FIG. 2, the power feeding line 5 and the ground line 6 are metal pieces that are obtained by bending extended portions of the flat metal plate 2 downward from two places as base ends with the first slot portion 3*a* of the radiating slot 3 interposed therebetween in its widthwise direction. Lower ends of both metal pieces are soldered to the circuit board. That is, the lower end of the power feeding line 5 is connected to the power feeding circuit, and the lower end of the ground line 6 is connected to a ground. Similarly, the power feeding line 7 and the ground line 8 are metal pieces that are obtained by bending extended portions of the flat metal plate 2 downward from two places as base ends with the first slot portion 4*c* of the radiating slot 4 interposed therebetween in its widthwise direction. A lower end of the power feeding line 7 is connected to the power feeding circuit, and a lower end of the ground line 8 is connected to a ground.

In the antenna device having such a configuration, the radiating slots 3 and 4 are simultaneously excited by power feeding via the feeding lines 5 and 7. Further, the radiating slots 3 and 4 have the same operation frequency, and thus the electric waves having the same frequency are simultaneously radiated from the pair of radiating slots 3 and 4. At this time, the polarization direction of the electric wave to be generated by the radiating slot 3 (the vibration direction of the compound vector Ev) is perpendicular to the polarization direction of the electric wave to be generated by the radiating slot 4 (the vibration direction of the compound vector Eh). Accordingly, polarization diversity can be constituted by the pair of radiating slots 3 and 4. Therefore, the antenna device can effectively receive signal waves of a wireless LAN or the like.

As described above, in the antenna device according to the present embodiment, the radiating slots 3 and 4 are line-symmetrically arranged, and the polarization direction of the electric wave to be generated by one radiating slot 3 is set to be perpendicular to the polarization direction of the electric wave to be generated by the other radiating slot 4. Therefore, even when the gap between both radiating slots 3 and 4 is narrow, a favorable isolation characteristic can be ensured. As a result, the reduction in size of the entire device can be promoted, without sacrificing the isolation characteristic. In FIG. 4 which is a graph showing the change of an S parameter according to the frequency, a characteristic curve R indicated by a solid line represents a return loss (S11 or S22) of each of the radiating slots 3 and 4, and a characteristic curve I indicated by a dotted line represents isolation (S21) between the radiating slots 3 and 4. As apparent from FIG. 4, when the operation frequency of each of the radiating slots 3 and 4 is 2.22 GHz, the return loss is equal to or more than −25 dB, and thus a favorable resonance characteristic is exhibited. At this time, the isolation between the radiating slots 3 and 4 also is equal to or more than −25 dB, and thus a favorable isolation characteristic is obtained.

Moreover, as another reason for the favorable isolation characteristic, the back-to-back arrangement is stated in which the edges of the first slot portions 3*a* and 4*c* face each other, and the second slot portions 3*b* and 4*d* extend in the direction to be separated from each other. That is, even when the entire device is reduced in size, the first slot portions 3*a* and 4*c* of both radiating slots 3 and 4 open at positions sufficiently separated from the outer edges of the flat metal plate 2. Therefore, the electric field to be generated by the first slot portions 3*a* and 4*c* are hard to be radiated to the lateral sides, and thus the first slot portions 3*a* and 4*c* do not cause degradation of the isolation characteristic.

Further, in the antenna device, the power feeding lines 5 and 7 and the ground lines 6 and 8 formed of the metal pieces extending from the flat metal plate 2 are used as the power feeding units of both radiating slots 3 and 4. Therefore, an entire antenna device including the power feeding units can be formed of only the sheet metal. As a result, the antenna device can be manufactured at low cost.

Figure 5:
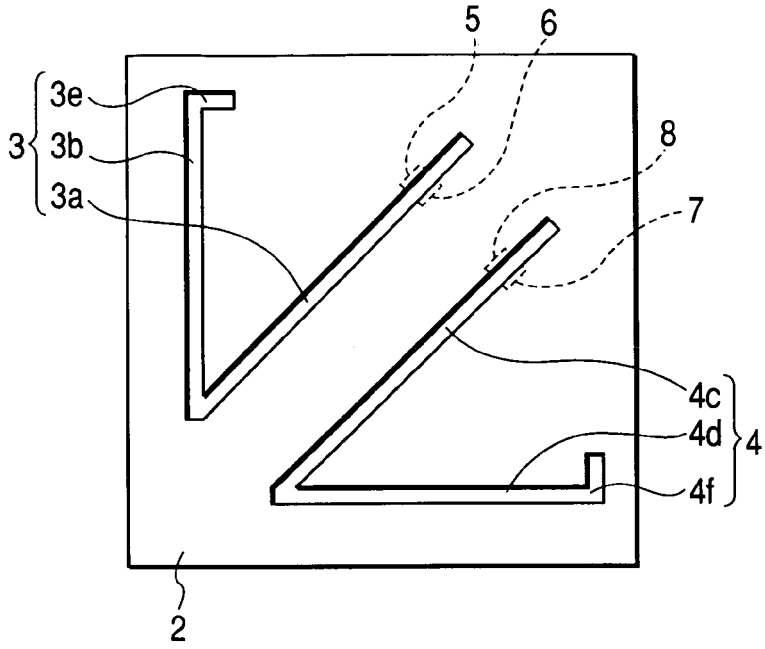
FIG. 5 is a plan view of an antenna device according to a second embodiment of the invention.
Figure 6:
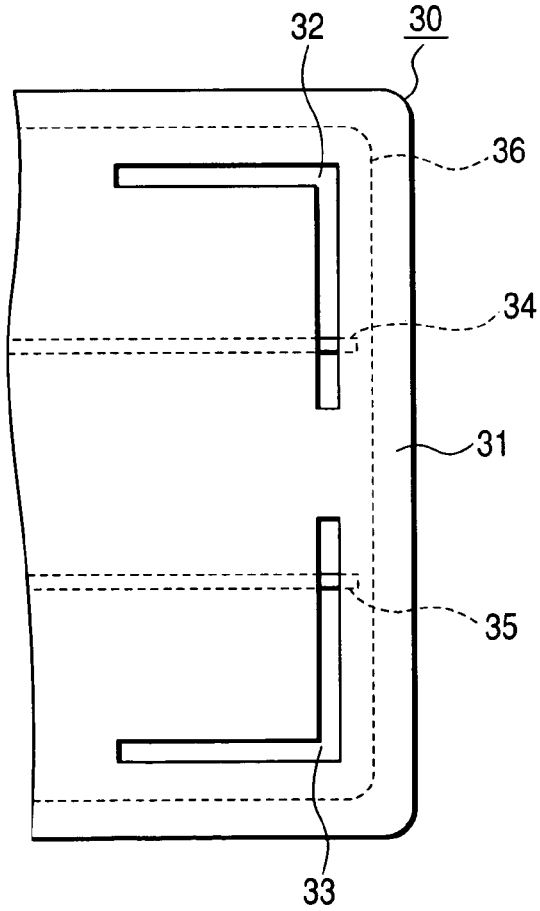
FIG. 6 PRIOR ART
FIG. 6 is a plan view of an antenna device according to the related art.

FIG. 5 is a plan view of an antenna device according to a second embodiment of the invention. In FIG. 5, the same parts as those in FIG. 3 are represented by the same reference numerals, and the descriptions thereof will be omitted.

An antenna device shown in FIG. 5 is different from the first embodiment of the invention in that the radiating slots 3 and 4 have third slot portions 3*e* and 4*f* at the front ends of the second slot portions 3*b* and 4*d*, respectively. That is, in the radiating slot 3, in addition to the first and second slot portions 3*a* and 3*b*, the short third slot portion 3*e* is provided to be connected to an end of the second slot portion 3*b* opposite to the side which is connected to the first slot portion 3*a*. The third slot portion 3*e* extends along an outer edge (upper side in FIG. 5) of the flat metal plate 2. Similarly, in the radiating slot 4, in addition to the first and second slot portions 4*c* and 4*d*, the short third slot portion 4*f* is provided to be connected to an end of the second slot portion 4*d* opposite to the side which is connected to the first slot portion 4*c*. The third slot portion 4*f* extends along an outer edge (right side in FIG. 5) of the flat metal plate 2. Therefore, the resonance lengths of the individual radiating slots 3 and 4 can be increased, without damaging the space factor. As a result, the reduction in size of the antenna device can be promoted.

Moreover, in the above-described embodiments, the flat metal plate 2 has the square shape, but, if the flat metal plate 2 substantially has a square shape in which four corners of the square shape are rounded, the reduction in size of the antenna device can be further realized.

Further, instead of providing the pair of radiating slots 3 and 4 in the metal plate, a metal film may be provided on a dielectric substrate. In this case, though manufacturing costs are increased, as compared with the above-described embodiments, the reduction in size of the antenna device can be easily promoted with a wavelength shortening effect by the dielectric.

In the antenna device of the invention, the polarization direction of the electric wave to be generated by one of the radiating slots provided in parallel with respect to the symmetry axis and the polarization direction of the electric wave to be generated by the other radiating slot are set to be perpendicular to each other. Therefore, even when the gap between both radiating slots is narrow, a favorable isolation characteristic can be ensured. Further, the pair of radiating slots are arranged in the back-to-back manner that the edges of the first slot portions face each other with the symmetry axis interposed therebetween, and the second slot portions extend to be connected to one end of the first slot portions in the direction to be separated from each other. Therefore, even when the space factor is enhanced, and the reduction in size is promoted, the first slot portions do not cause degradation of the isolation characteristic. Therefore, an antenna device which has a favorable isolation characteristic and easily promotes a reduction in size can be implemented.

In particular, when the external shape of the conductor member is substantially a square shape in plan view, one diagonal line of the square shape is aligned with the symmetry axis, and an angle at which the first and second slot portions contact is set to about 45 degrees, the reduction in size of the entire device can be rapidly promoted.

The invention claimed is:

1. An antenna device comprising:

a pair of radiating slots that open in a common conductor member to be line-symmetrically arranged with respect to a predetermined symmetry axis; and power feeding units that excite the radiating slots, respectively, wherein each of the radiating slots has a first slot portion, one edge of which is close to the symmetry axis, and a second slot portion that is connected to one end of the first slot portion to extend in a direction distant from the symmetry axis, and a polarization direction of an electric wave to be generated by one radiating slot and a polarization direction of an electric wave to be generated by the other radiating slot are set to be perpendicular to each other.

2. The antenna device according to claim 1, wherein the first slot portion extends parallel to the symmetry axis.

3. The antenna device according to claim 2, wherein an external shape of the conductor member is substantially a square shape in plan view, one diagonal line of the square shape is aligned with the symmetry axis, and an angle at which the first and second slot portions contact is set to about 45 degrees.

4. The antenna device according to claim 3, wherein each of the radiating slots has a third slot portion that is connected to an end of the second slot portion, which is connected to the first slot portion, so as to extend along an outer edge of the square shape.

5. The antenna device according to claim 1, wherein the conductor member is formed of a metal plate.

6. The antenna device according to claim 5, wherein two metal pieces are provided in a peripheral portion of each of the radiating slots, the metal pieces being obtained by bending extended portions of the metal plate from two places as base ends with the corresponding radiating slot interposed therebetween in its widthwise direction, and one of the two metal pieces becomes a power feeding line and the other metal piece becomes a ground line.

7. The antenna device according to claim 1, wherein the conductor member is formed of a metal film formed in a dielectric substrate.

* * * * *